US010132085B2

(12) United States Patent
Bredeweg et al.

(10) Patent No.: US 10,132,085 B2
(45) Date of Patent: Nov. 20, 2018

(54) HOOKING DRIP EDGE ASSEMBLY

(71) Applicant: Quality Edge, Inc., Walker, MI (US)

(72) Inventors: Mark Allen Bredeweg, Zeeland, MI (US); Craig Scott Rasmussen, Ada, MI (US)

(73) Assignee: Quality Edge, Inc., Walker, MI (US)

( * ) Notice: Subject to any disclaimer, the term of this patent is extended or adjusted under 35 U.S.C. 154(b) by 0 days.

(21) Appl. No.: 15/425,540

(22) Filed: Feb. 6, 2017

(65) Prior Publication Data

US 2018/0223537 A1 Aug. 9, 2018

(51) Int. Cl.
*E04D 13/158* (2006.01)
*E04D 13/04* (2006.01)

(52) U.S. Cl.
CPC ..... *E04D 13/158* (2013.01); *E04D 13/0459* (2013.01); *E04D 2013/0486* (2013.01)

(58) Field of Classification Search
CPC ..... E04D 13/0459; E04D 2013/0468; E04D 13/0486; E04D 2013/0486; E04D 13/048; E04D 13/158
See application file for complete search history.

(56) References Cited

U.S. PATENT DOCUMENTS 1,406,757 A * 2/1922 Pruden ..... E04D 13/0459 52/11
1,904,404 A 4/1933 Burk
2,697,932 A 12/1954 Goodwin
2,734,602 A * 2/1956 Dawson ..... E06B 1/702 52/204.5
3,137,970 A * 6/1964 Tiernan ..... E04D 13/15 52/630
3,192,670 A * 7/1965 Jones, III ..... E04D 13/15 52/302.1
3,243,926 A * 4/1966 Keyt ..... E04D 13/15 52/287.1
3,254,460 A * 6/1966 Bowser ..... E04D 13/15 52/533
5,170,597 A * 12/1992 Stearns ..... E04D 13/0459 52/11

(Continued)

FOREIGN PATENT DOCUMENTS

CA 2267409 A1 * 9/1999 ..... E03D 13/0459
EP 2189587 A1 * 5/2010 ..... E04D 13/0459
GB 2401615 A * 11/2004 ..... E04D 13/15

*Primary Examiner* — Babajide A Demuren
(74) *Attorney, Agent, or Firm* — Price Heneveld LLP

(57) ABSTRACT

A drip edge assembly having an underlying drip edge. A body portion includes first and second ribs extending therealong. The body portion includes an inner edge having a fold and an outer edge that includes a protrusion. A vertical wall extends downward from the body portion and includes a lower kick defining an inwardly-facing channel. An overlying drip edge includes a body portion having first and second ribs extending therealong. The body portion includes an inner edge having a fold and an outer edge that includes a protrusion. A vertical wall extends downward from the body portion and includes a lower kick defining a rearwardly-facing channel. The lower kick of the underlying drip edge is configured to define a pivot axis about which the overlying drip edge rotates during assembly.

9 Claims, 6 Drawing Sheets

(56) References Cited

U.S. PATENT DOCUMENTS

| | | | | |
|---|---|---|---|---|
| 5,414,965 | A * | 5/1995 | Kelley | E04D 13/064 52/60 |
| 5,586,414 | A * | 12/1996 | Tawzer | E04D 5/14 52/199 |
| 5,893,247 | A | 4/1999 | Hickman et al. | |
| 6,035,587 | A * | 3/2000 | Dressler | E04D 13/0459 52/716.2 |
| D651,293 | S * | 12/2011 | Sager, Sr. | D23/267 |
| 8,069,619 | B1 | 12/2011 | Inzeo | |
| 8,281,521 | B1 * | 10/2012 | Rasmussen | E04D 13/0459 52/409 |
| 2005/0005551 | A1 | 1/2005 | Graham et al. | |
| 2005/0193642 | A1 * | 9/2005 | Brochu | E04D 13/158 52/58 |
| 2006/0080900 | A1 | 4/2006 | Graham et al. | |
| 2007/0074466 | A1 * | 4/2007 | Rasmussen | E04D 13/0459 52/97 |
| 2011/0209434 | A1 * | 9/2011 | Nark | G06Q 10/00 52/745.21 |

* cited by examiner

HOOKING DRIP EDGE ASSEMBLY

BACKGROUND OF THE DISCLOSURE

The present disclosure generally relates to a drip edge assembly, and more particularly to a hooking drip edge assembly.

SUMMARY OF THE DISCLOSURE

One aspect of the disclosure includes a drip edge assembly having an underlying drip edge. A body portion includes first and second ribs extending therealong. The body portion includes an inner edge having a fold and an outer edge that includes a protrusion. A vertical wall extends downward from the body portion and includes a lower kick defining a rearwardly-facing channel. An overlying drip edge includes a body portion having first and second ribs extending therealong. The body portion includes an inner edge having a fold and an outer edge that includes a protrusion. A vertical wall extends downward from the body portion and includes a lower kick defining an inwardly-facing channel. The lower kick of the underlying drip edge is configured to define a pivot axis about which the overlying drip edge rotates during assembly.

Another aspect of the disclosure includes a method of installing a drip edge assembly. A body portion of a first drip edge is coupled to a roof. A second drip edge abuts the first drip edge. A lower kick of the second drip edge is positioned over the first drip edge. The second drip edge is moved upward until a body portion of the second drip edge is abutting and parallel with the body portion of the first drip edge.

Still another aspect of the disclosure includes a method of manufacturing a drip edge assembly. A body portion having first and second ribs is formed and extends therealong. An inner edge of the body portion is formed to include a fold. A vertical wall extends downward from the body portion. A lower kick is formed that defines an inwardly-facing channel.

These and other features, advantages, and objects of the present disclosure will be further understood and appreciated by those skilled in the art by reference to the following specification, claims, and appended drawings.

DETAILED DESCRIPTION

Figure 1:
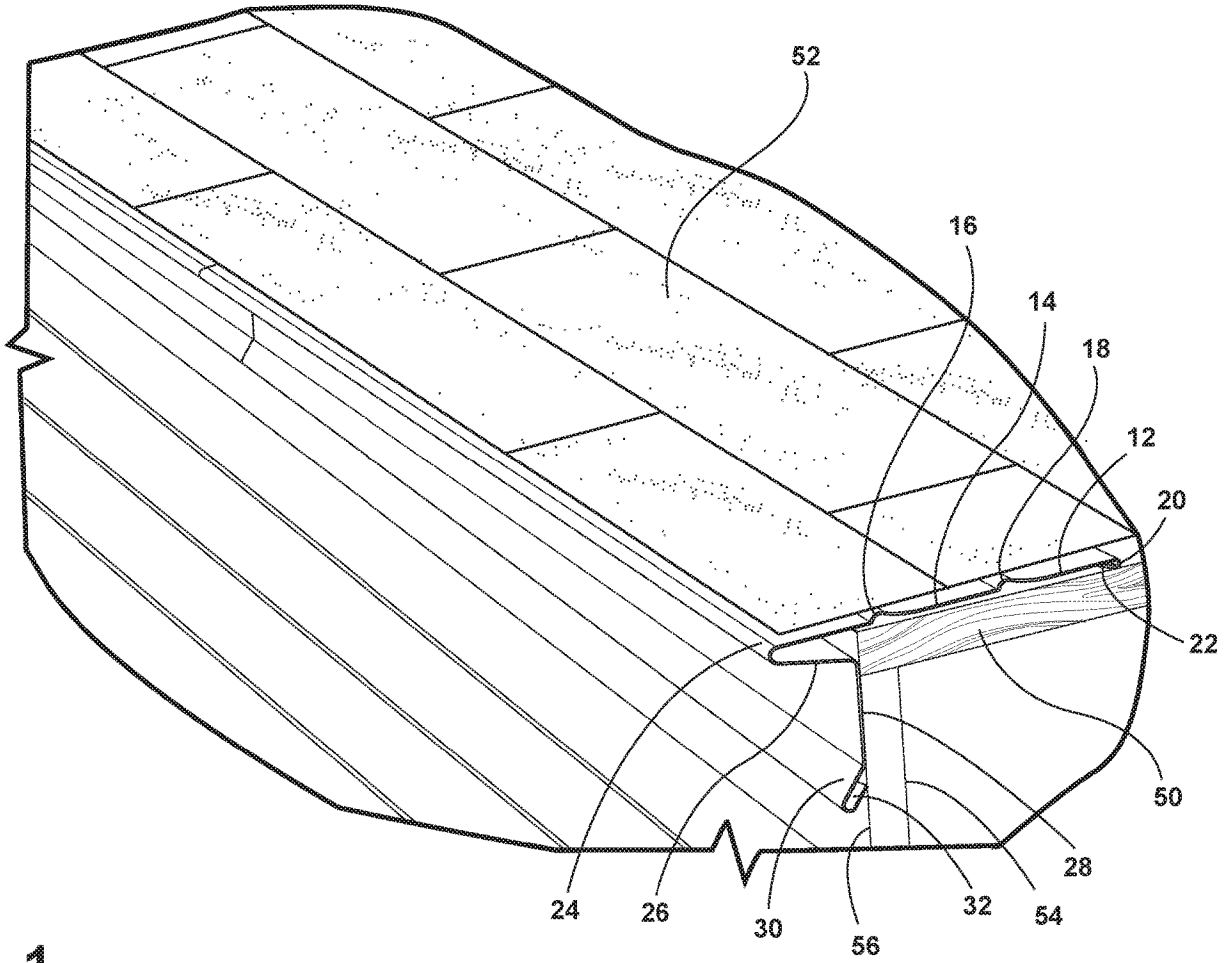
FIG. 1 is a top perspective view of a drip edge assembly of the present disclosure.

The present illustrated embodiments reside primarily in combinations of method steps and apparatus components related to a drip edge assembly. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the device closer to an intended viewer of the device, and the term "rear" shall refer to the surface of the device further from the intended viewer of the device. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring now to FIGS. 1-6, reference numeral 10 generally designates a drip edge assembly having an underlying drip edge 12. A body portion 14 of the underlying drip edge 12 includes first and second ribs 16, 18 extending therealong. The body portion 14 includes an inner edge 20 having a fold 22 and an outer edge 24 that includes a protrusion 26. A vertical wall 28 extends downward from the body portion 14 and includes a lower kick 30 defining a rearwardly-facing channel 32. An overlying drip edge 12A includes a body portion 14A having first and second ribs 16A, 18A extending therealong. The body portion 14A includes an inner edge 20A having a fold 22A and an outer edge 24A that includes a protrusion 26A. A vertical wall 28A extends downward from the body portion 14A and includes a lower kick 30A defining a rearwardly-facing channel 32A. The lower kick 30 of the underlying drip edge 12 is configured to define a pivot axis about which the overlying drip edge 12A rotates during assembly.

Figure 2:
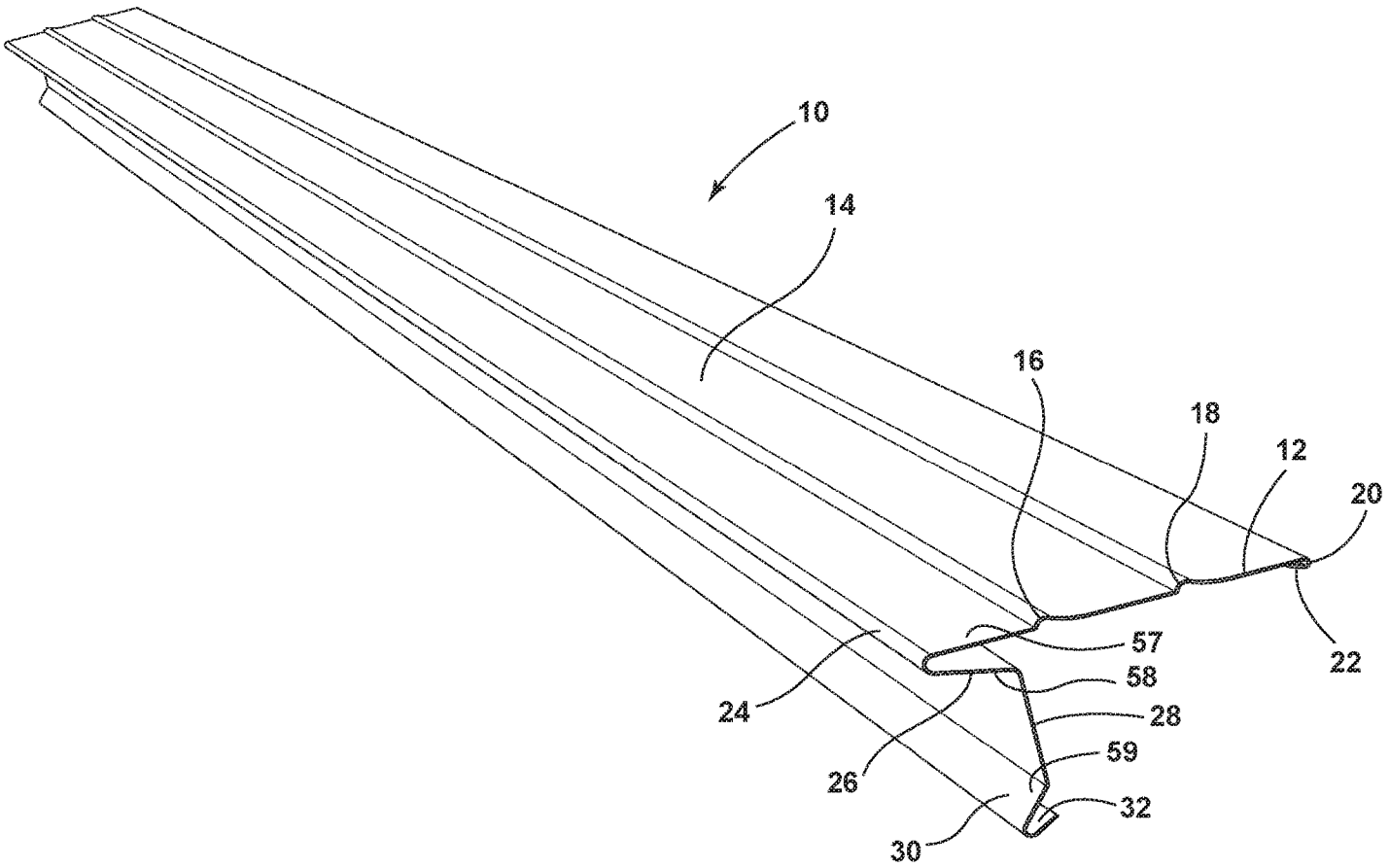
FIG. 2 is a top perspective view of an underlying drip edge of the present disclosure.

With reference again to FIG. 1, the drip edge assembly 10 is generally configured for use between an underlying wood roof 50 and shingles 52 that cover the wood roof 50. The drip edge assembly 10 will generally be located on an overhang 54 and may abut fascia 56 of the overhang 54 (as shown in FIG. 1). As shown in FIG. 2, the drip edge assembly 10 includes an elongate body portion 14 configured to extend along the fascia 56 of the overhang 54. The elongate body portion 14 may have varying lengths and may also be cut to length, depending on the application. The elongate body portion 14 of the drip edge assembly 10 may be coupled with the underlying wood roof 50 via fasteners, including nails, screws, etc., or an adhesive. Regardless, it is generally contemplated that the drip edge 12 protects the interface between the shingles 52 and the underlying wood roof 50, protecting the same from extended exposure to the elements.

Figure 3:
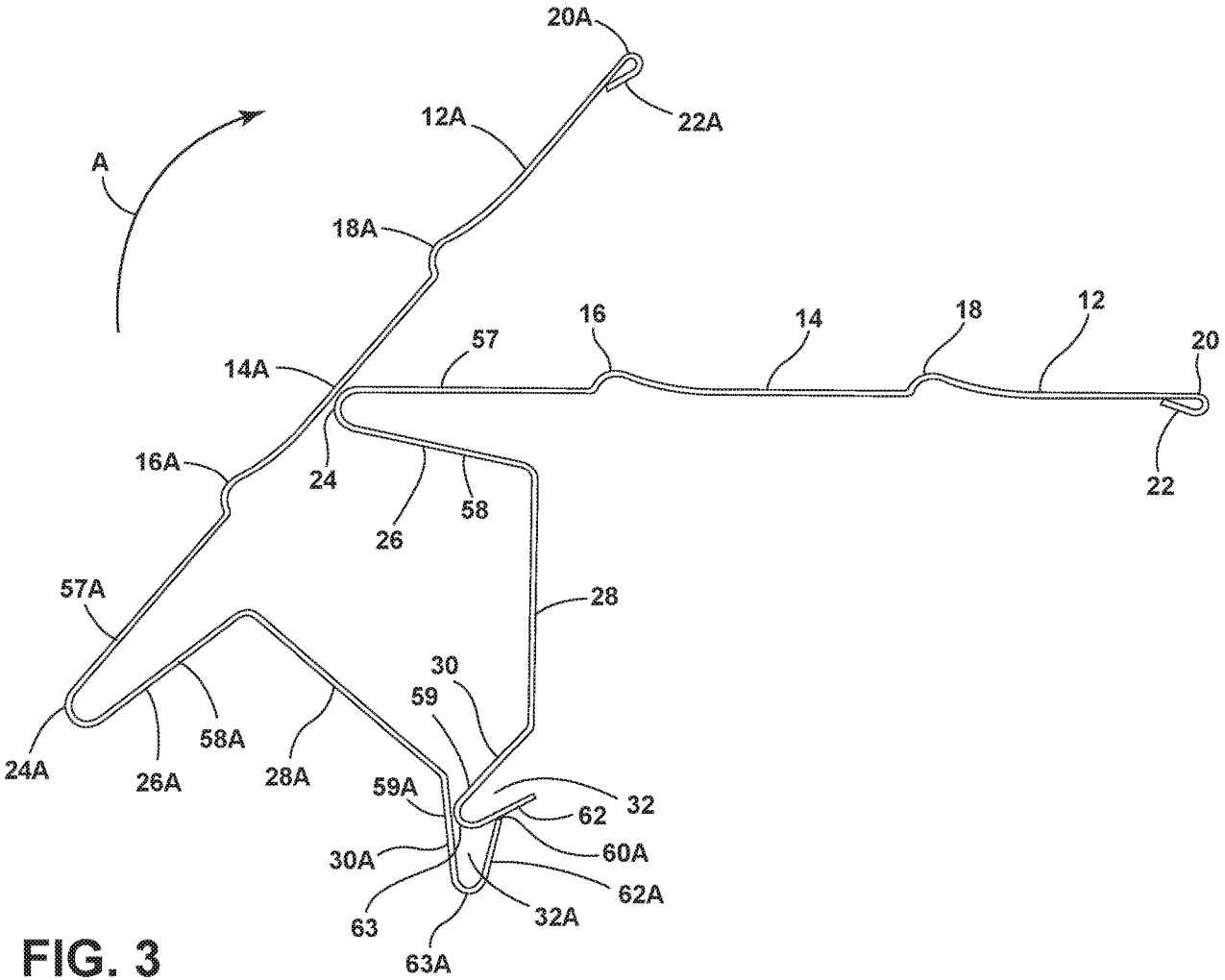
FIG. 3 is a side elevational view of an underlying drip edge operably coupled with a roof during installation with an overlying drip edge.

With reference now to FIG. 3, the drip edge assembly 10 includes a multitude of formations configured to provide a robust structure that prevents or minimizes exposure of an edge line of the underlying wood roof 50 to the elements. The body portion 14 is generally divided into three equal segments defined by the first and second ribs 16, 18. However, it will be understood that the first and second ribs 16, 18 could be closer together, or moved closer to the protrusion 26 or closer to the inner edge 20 than illustrated in FIG. 3. It will be understood that the top portion 57 of the protrusion 26 is generally defined by the first segment of the body portion 14. As illustrated, the protrusion 26 extends laterally beyond a lateral extent of the lower kick 30. This is clearly illustrated in both FIG. 2, as well as FIG. 3. As illustrated, the protrusion 26 includes a larger radius than a radius of the lower kick 30. Variations to this construction will be understood by one having ordinary skill in the art. The protrusion 26 is defined by a top portion 57 and a bottom portion 58. The top portion 57 and the bottom portion 58 terminate at the outer edge 24. The vertical wall 28 extends downwardly from the bottom portion 58 of the protrusion 26 in a direction generally orthogonal relative to the planar extent of the body. An outwardly-extending portion 59 of the lower kick 30 extends from the vertical wall 28. An inwardly-extending return 62 of the lower kick 30 and the outwardly-extending portion 59 of the lower kick 30 terminate at a distal end 63. Additionally, the lower kick 30 is generally defined by the outwardly-extending portion 59 and the inwardly-extending return 62, which extend at an acute angle relative to one another.

Figure 4:
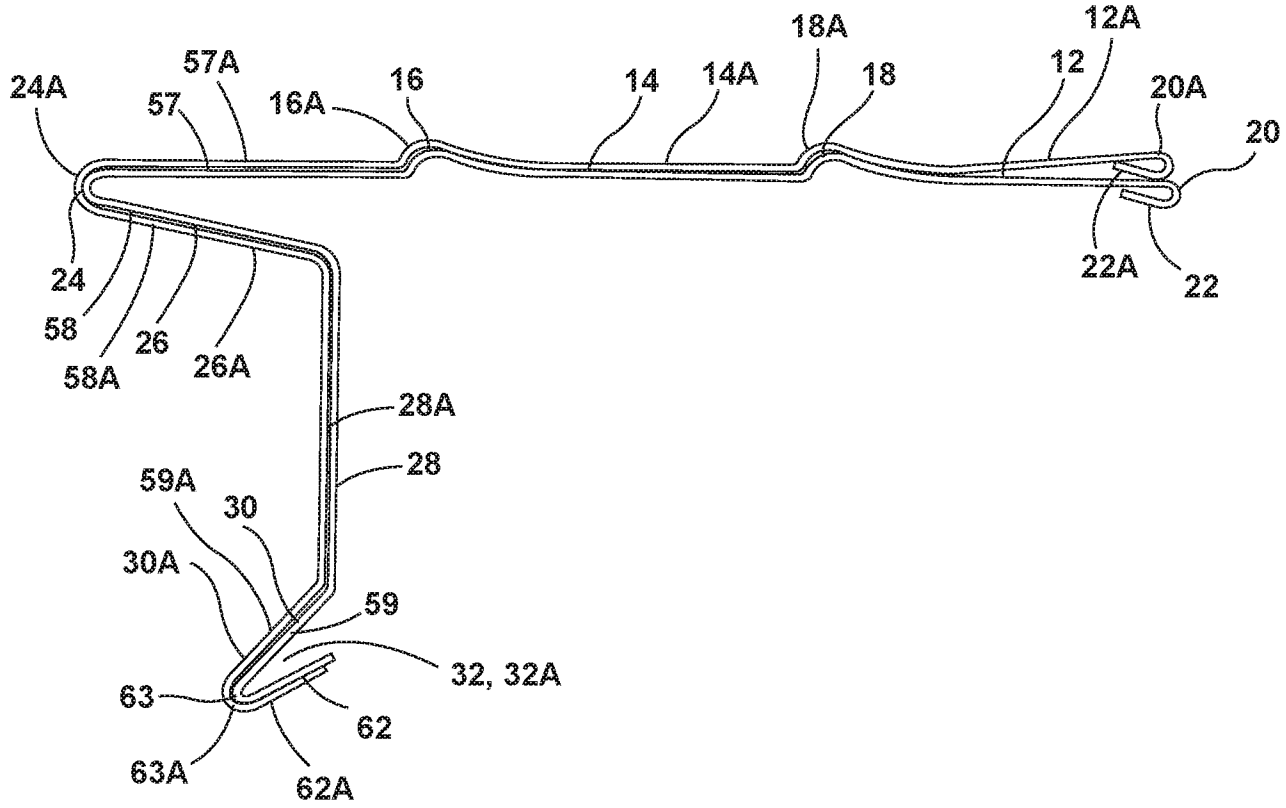
FIG. 4 is a side perspective view of an overlying drip edge in abutting contact with an underlying drip edge.

With reference again to FIG. 3, during installation, the drip edge 12 may be installed in a number of different ways. In one instance, a first underlying drip edge 12 is operably coupled with the roof. An overlying drip edge 12A is then positioned adjacent to the underlying drip edge 12 such that the lower kick 30A of the overlying drip edge 12A is in abutting contact with the underlying lower kick 30 of the underlying drip edge 12. More specifically, a distal end 60A of an inwardly-extending return 62A of the lower kick 30A abuts an inwardly-extending return 62 of the lower kick 30. At the same time, the body portion 14A of the overlying drip edge 12A is in abutting contact with the outer edge 24 of the protrusion 26 of the underlying drip edge 12. The overlying drip edge 12A is then rotated in the direction of arrow A until a bottom surface of the overlying drip edge 12A is in abutting contact with a top surface of the underlying drip edge 12 (FIG. 4). In this instance, the body portion 14 of the underlying drip edge 12 and the body portion 14A of the overlying drip edge 12A are parallel with one another and in abutting contact. The inwardly-extending return 62A of the lower kick 30A is also abutting the inwardly-extending return 62 of the lower kick 30. The fold 22A of the body portion 14A of the overlying drip edge 12A rests on and abuts with the inner edge 20 of the underlying drip edge 12.

Figure 5:
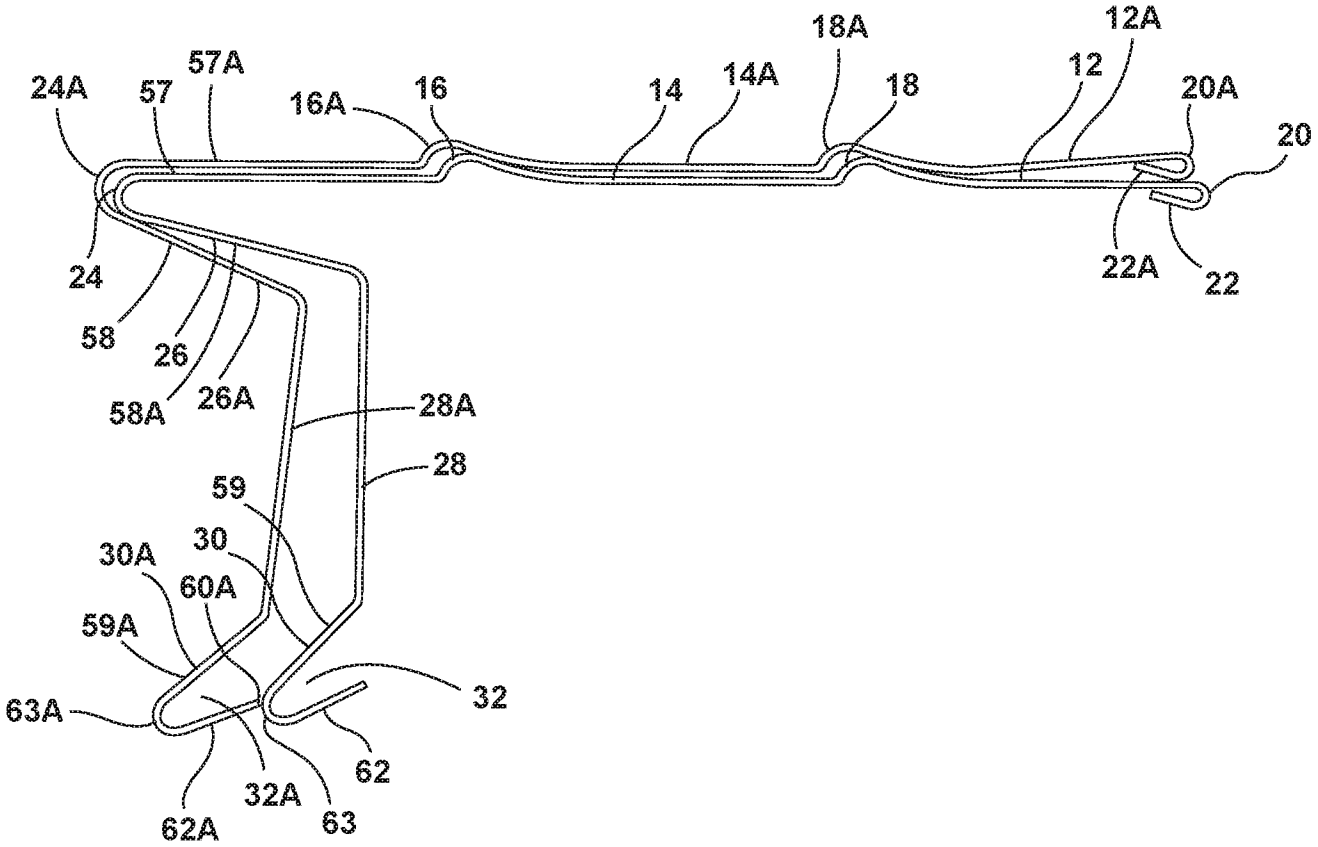
FIG. 5 is a side perspective view of a drip edge assembly of the present disclosure operably coupled with a roof of a dwelling.
Figure 6:
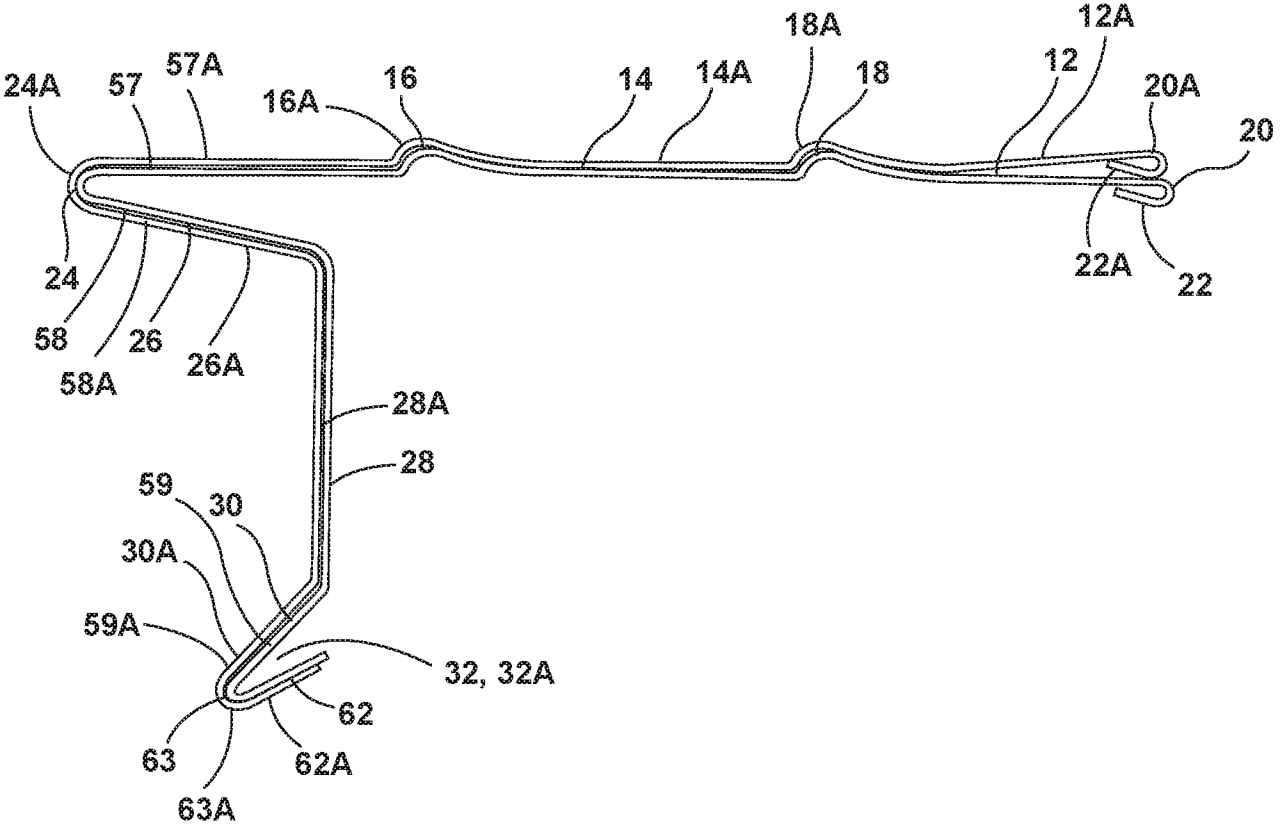
FIG. 6 is a side perspective view of another drip edge assembly of the present disclosure.

It is also generally contemplated that the drip edge assembly 10 could be installed in another manner. Specifically, as shown in FIG. 5, the underlying drip edge 12 can be operably coupled with the roof of a dwelling. The overlying drip edge 12A is then positioned over the underlying drip edge 12, as shown in FIG. 5 so that the bottom surface of the overlying drip edge 12A is in abutting contact with the top surface of the underlying drip edge 12. The overlying drip edge 12A may be mechanically fastened to the underlying drip edge 12 or adhered thereto, as noted above. The lower kick 30A of the overlying drip edge 12A is then pulled out slightly so that the lower kick 30A can be snapped around the lower kick 30 of the underlying drip edge 12. After the lower kick 30A snaps around the lower kick 30, the inwardly-extending return 62A of the lower kick 30A is in abutting contact with and extending in a parallel direction with the inwardly-extending return 62 of the lower kick 30 of the underlying drip edge 12.

The aforementioned drip edge assembly 10 is generally configured to provide a smooth and seamless drip edge that includes a tight fit, thereby appealing aesthetically to consumers. In addition, the drip edge assembly 10 is configured to provide an ideal wrap to the underlying wood roof 50, thereby lessening the likelihood of damage to the wood roof 50 by weather, wind, etc.

It will be understood by one having ordinary skill in the art that construction of the described disclosure and other components is not limited to any specific material. Other exemplary embodiments of the disclosure disclosed herein may be formed from a wide variety of materials, unless described otherwise herein. It will also be understood that features with like reference numbers, but which include the letter "A," are similar features, but on different drip edge assemblies.

For purposes of this disclosure, the term "coupled" (in all of its form, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present disclosure, and further it is to be understood that such concepts are intended to be covered by the following claims unless these claims by their language expressly state otherwise.

What is claimed is:

1. A drip edge assembly comprising:

an underlying drip edge comprising:

a body portion having first and second ribs extending therealong that generally divide the body portion into first, second, and third segments, wherein the third segment includes an inner edge that includes a fold and the first segment includes an outer edge that includes a protrusion;

a vertical wall extending downward from the body portion and including a lower kick defining a rearwardly-facing channel; and an overlying drip edge comprising:

a body portion having first and second ribs extending therealong, the body portion further including an inner edge that includes a fold and an outer edge that includes a protrusion; and a vertical wall extending downward from the body portion and including a lower kick defining an inwardly-facing channel, wherein the lower kick of the underlying drip edge is configured to define a pivot axis about which the overlying drip edge rotates during assembly, the protrusion defining a protrusion radius that is larger than a radius defined by the lower kick.

2. The drip edge assembly of claim 1, wherein the lower kick is defined by an outwardly-extending portion and an inwardly-extending return that extend at an acute angle relative to one another.

3. The drip edge assembly of claim 1, wherein the vertical wall extends downwardly orthogonally from the body portion.

4. The drip edge assembly of claim 1, wherein the protrusion extends laterally beyond a lateral extent of the lower kick.

5. The drip edge assembly of claim 1, wherein the first and second ribs generally divide the body portion into three equal segments.

6. The drip edge assembly of claim 5, wherein a top portion of the protrusion is defined by the first segment of the body portion.

7. A method of installing a drip edge assembly, the method comprising:

coupling a body portion of a first drip edge to a roof;

abutting a second drip edge to the first drip edge;

positioning a lower kick of the second drip edge proximate a lower kick of the first drip edge; and rotating the second drip edge upward about the lower kick of the first drip edge until a body portion of the second drip edge is abutting and parallel with the body portion of the first drip edge and a fold of the second drip edge abuts with at least one of the body portion of the first drip edge and an inner portion of the first drip edge.

8. The method of claim 7, wherein the step of rotating the second drip edge upward further comprises:

rotating the second drip edge upward about the lower kick of the first drip edge until a body portion of the second drip edge is abutting and parallel with the body portion of the first drip edge.

9. The method of claim 7, wherein the step of rotating the second drip edge upward further comprises:

placing the body portion of the second drip edge on the body portion of the first drip edge, and snapping the lower kick of the second drip edge over a lower kick of the first drip edge.

* * * * *